US011241075B2

(12) United States Patent
Silva

(10) Patent No.: US 11,241,075 B2
(45) Date of Patent: Feb. 8, 2022

(54) COSMETIC APPLICATOR TOOL AND CONTAINER SYSTEM

(71) Applicant: Rea.deeming Beauty, Inc., Bethlehem, PA (US)

(72) Inventor: Rea Ann Silva, Bethlehem, PA (US)

(73) Assignee: REA.DEEMING BEAUTY, INC., Bethlehem, PA (US)

( * ) Notice: Subject to any disclaimer, the term of this patent is extended or adjusted under 35 U.S.C. 154(b) by 864 days.

(21) Appl. No.: 15/402,979

(22) Filed: Jan. 10, 2017

(65) Prior Publication Data

US 2017/0208919 A1 Jul. 27, 2017

Related U.S. Application Data

(63) Continuation of application No. 29/556,321, filed on Feb. 29, 2016, now Pat. No. Des. 800,966, and a
(Continued)

(51) Int. Cl.
*A45D 40/20* (2006.01)
*A45D 40/30* (2006.01)
(Continued)

(52) U.S. Cl.
CPC ..... *A45D 40/30* (2013.01); *B65D 43/163* (2013.01); *B65D 85/54* (2013.01); *A45D 2040/0006* (2013.01)

(58) Field of Classification Search
CPC ..... B65D 85/54; A45D 40/30; A45D 44/12; A45D 44/02
See application file for complete search history.

(56) References Cited

U.S. PATENT DOCUMENTS 558,535 A 4/1896 Erard
1,247,906 A 11/1917 Tully
(Continued)

FOREIGN PATENT DOCUMENTS

CH 684574 10/1994
CN 201001673 1/2008
(Continued)

OTHER PUBLICATIONS

Cardellino, Carly, "This New Beauty Tool Will Change the Way You Do Cat-Eyes Forever," Cosmopolitan, Jan. 12, 2016.Retrieved from the Inrternet on Mar. 4, 2017.
(Continued)

*Primary Examiner* — Cris L. Rodriguez
*Assistant Examiner* — Brianne E Kalach
(74) *Attorney, Agent, or Firm* — Concept IP LLP; Pejman Yedidsion

(57) ABSTRACT

Methods, devices, and systems of cosmetic applicator tool and container (100) are disclosed; where a triangular shaped cosmetic applicator tool (110) having a combination of rectilinear (225) and curvilinear sides (221,223), may be made of flexible material and may further comprise a tacky coating to adhere to a skin surface. Additionally, the cosmetic applicator tool and container (100) may include a storage housing (150) comprising a removable lid member (160) and a base member (170), where the base member (170) may facilitate affixing of the storage housing to a solid flat surface via providing a suction cup, and where the storage housing (150) may be configured to receive and store the cosmetic applicator tool (110) and suction cup.

20 Claims, 9 Drawing Sheets

Related U.S. Application Data continuation of application No. 29/552,719, filed on Jan. 25, 2016, now Pat. No. Des. 788,977.

(51) Int. Cl.

| | |
|---|---|
| ***B65D 43/16*** | (2006.01) |
| ***B65D 85/00*** | (2006.01) |
| *A45D 40/00* | (2006.01) |

(56) References Cited

U.S. PATENT DOCUMENTS

| | | | | |
|---|---|---|---|---|
| 1,380,208 | A | 5/1921 | Holtschneider | |
| 1,589,215 | A | 6/1926 | Forest | |
| 1,732,028 | A | 10/1929 | Reiner | |
| 1,743,611 | A | 1/1930 | Larson | |
| 2,247,600 | A | 7/1941 | Brennan et al. | |
| 2,255,503 | A | 9/1941 | Carbary | |
| 2,438,129 | A | 3/1948 | Richard | |
| 2,537,534 | A | 1/1951 | Joseph | |
| 2,555,047 | A | 5/1951 | Floyd | |
| 2,620,085 | A | 12/1952 | Baldanza | |
| 2,657,090 | A | 10/1953 | Meek | |
| 2,708,595 | A | 5/1955 | Carl | |
| 2,738,225 | A | 3/1956 | Meek | |
| 2,765,194 | A | 10/1956 | Theodore | |
| 2,769,565 | A | 11/1956 | John | |
| 2,783,084 | A | 2/1957 | Worthen | |
| 2,836,462 | A | 5/1958 | Wenner | |
| 2,878,060 | A | 3/1959 | Dello | |
| 2,958,469 | A | 11/1960 | Shuster | |
| 3,188,157 | A | 6/1965 | Rand | |
| 3,472,242 | A | 10/1969 | Demner | |
| 3,686,788 | A | 8/1972 | Braunhut | |
| 3,754,707 | A | 8/1973 | Morane | |
| 3,848,803 | A | 11/1974 | Levey | |
| 4,033,650 | A | 7/1977 | Alissandratos | |
| 4,084,732 | A | 4/1978 | Dearling | |
| 4,258,874 | A | 3/1981 | Webinger et al. | |
| 4,293,095 | A | 10/1981 | Hamilton et al. | |
| 4,306,679 | A | 12/1981 | Dusek et al. | |
| 4,323,193 | A | 4/1982 | Compton et al. | |
| 4,345,512 | A | 8/1982 | Moore | |
| 4,502,630 | A | 3/1985 | Haworth et al. | |
| 4,532,719 | A | 8/1985 | Davies et al. | |
| 4,532,722 | A | 8/1985 | Sax | |
| D280,757 | S | 9/1985 | Paulovich et al. | |
| 4,545,917 | A | 10/1985 | Smith et al. | |
| 4,549,693 | A | 10/1985 | Barlics | |
| 4,567,675 | A | 2/1986 | Rennie | |
| 4,696,317 | A | 9/1987 | Shioi et al. | |
| 4,739,928 | A | 4/1988 | O'Neil | |
| 1,299,561 | A | 1/1989 | Bakic | |
| 4,840,288 | A | 6/1989 | Lunderman et al. | |
| D302,872 | S | 8/1989 | Bakic | |
| 1,303,163 | A | 8/1989 | Bakic | |
| D303,581 | S | 9/1989 | Bakic | |
| D317,044 | S | 5/1991 | Thomson | |
| 5,033,674 | A | 7/1991 | Smith | |
| 5,163,616 | A | 11/1992 | Bernarducci et al. | |
| 1,339,882 | A | 9/1993 | Chevassus | |
| 5,314,669 | A | 5/1994 | Hamilton | |
| 1,355,486 | A | 2/1995 | Ikeda | |
| D357,531 | S | 4/1995 | Weick | |
| 5,437,410 | A | 8/1995 | Babasade | |
| 5,526,966 | A | 6/1996 | Lutzker | |
| 5,690,275 | A | 11/1997 | Bose et al. | |
| 5,768,917 | A | 6/1998 | Freida | |
| 6,032,495 | A | 3/2000 | Leu | |
| D424,751 | S | 5/2000 | Kudo et al. | |
| D424,753 | S | 5/2000 | Grossnickle et al. | |
| 6,174,577 | B1 | 1/2001 | Vitorino | |
| 6,186,324 | B1 | 2/2001 | Catterson | |
| 6,199,560 | B1 * | 3/2001 | North | A45D 44/12 132/319 |
| 6,245,230 | B1 | 6/2001 | Ricci | |
| 6,338,406 | B1 | 1/2002 | Zagar | |
| 6,363,947 | B1 | 4/2002 | Wu | |
| 6,457,583 | B1 | 10/2002 | Tee et al. | |
| D478,973 | S | 8/2003 | Wagner | |
| 6,601,591 | B1 * | 8/2003 | Carullo | A45D 40/00 132/320 |
| D482,412 | S | 11/2003 | Manville | |
| D509,890 | S | 9/2005 | Stavale et al. | |
| D509,894 | S | 9/2005 | Hoyt et al. | |
| 6,966,500 | B1 | 11/2005 | Kelley | |
| D517,733 | S | 3/2006 | Tsai | |
| 7,350,720 | B2 | 4/2008 | Jaworski et al. | |
| 7,360,650 | B2 | 4/2008 | Hoffecker | |
| D579,163 | S | 10/2008 | Schablinger | |
| D584,391 | S | 1/2009 | Howlett et al. | |
| D599,958 | S | 9/2009 | Washington | |
| D617,439 | S | 6/2010 | Valentino et al. | |
| D639,922 | S | 6/2011 | Howlett et al. | |
| 8,235,060 | B2 * | 8/2012 | Konrad | A45D 40/30 132/200 |
| 8,240,503 | B2 | 8/2012 | Curtin | |
| 8,251,299 | B1 | 8/2012 | Irvin | |
| 8,523,020 | B2 | 9/2013 | Abfall et al. | |
| 8,550,290 | B1 | 10/2013 | Davis | |
| 8,671,499 | B2 | 3/2014 | Lim et al. | |
| 8,778,430 | B2 | 7/2014 | Dietrich | |
| D713,095 | S | 9/2014 | Bishop et al. | |
| D735,947 | S | 8/2015 | Reyes et al. | |
| D736,312 | S | 8/2015 | Elbaum et al. | |
| 9,138,044 | B2 | 9/2015 | Lim et al. | |
| 9,220,391 | B1 | 12/2015 | Henninger | |
| 9,228,289 | B2 | 1/2016 | Oh | |
| D759,897 | S | 6/2016 | Eberlein et al. | |
| 9,440,186 | B2 | 9/2016 | Wasson | |
| D800,961 | S | 10/2017 | Silva | |
| D800,966 | S | 10/2017 | Silva | |
| D814,117 | S | 3/2018 | Gröning | |
| 10,510,335 | B2 | 12/2019 | Lazar et al. | |
| 2003/0094184 | A1 * | 5/2003 | Parsons | A45D 40/30 132/319 |
| 2004/0107975 | A1 | 6/2004 | Bender | |
| 2005/0173277 | A1 | 8/2005 | Rich | |
| 2005/0232681 | A1 | 10/2005 | Gueret | |
| 2005/0268935 | A1 | 12/2005 | Hoffecker | |
| 2006/0101707 | A1 | 5/2006 | James | |
| 2007/0001025 | A1 | 1/2007 | Caserta et al. | |
| 2007/0017915 | A1 | 1/2007 | Weder et al. | |
| 2007/0021783 | A1 | 1/2007 | Viana et al. | |
| 2007/0181455 | A1 | 8/2007 | Davis | |
| 2008/0318308 | A1 | 12/2008 | Hinchey | |
| 2009/0165327 | A1 | 7/2009 | Nekovar | |
| 2010/0003175 | A1 | 1/2010 | Gibson | |
| 2010/0018542 | A1 * | 1/2010 | Konrad | A45D 40/30 132/200 |
| 2010/0281928 | A1 | 11/2010 | Martin | |
| 2011/0180543 | A1 | 7/2011 | Rusnak et al. | |
| 2011/0284531 | A1 | 11/2011 | Chen | |
| 2012/0091221 | A1 | 4/2012 | Levake et al. | |
| 2012/0104113 | A1 | 5/2012 | Abfall et al. | |
| 2013/0186816 | A1 | 7/2013 | Kepner et al. | |
| 2014/0013501 | A1 | 1/2014 | Murphy et al. | |
| 2014/0069448 | A1 * | 3/2014 | Forsythe | A45D 40/30 132/200 |
| 2014/0154153 | A1 | 6/2014 | Averdam et al. | |
| 2015/0272416 | A1 | 10/2015 | Lu | |
| 2016/0000958 | A1 | 1/2016 | Matias | |
| 2016/0051033 | A1 * | 2/2016 | Abraham | A45D 40/30 132/200 |
| 2016/0278588 | A1 | 9/2016 | Caldwell et al. | |
| 2016/0302389 | A1 | 10/2016 | Christensen | |
| 2017/0143102 | A1 | 5/2017 | Silva | |
| 2018/0168333 | A1 | 6/2018 | Zeilah | |

FOREIGN PATENT DOCUMENTS

| | | | |
|---|---|---|---|
| CN | 201801065 | U | 4/2011 |
| CN | 102665485 | A | 9/2012 |
| CN | 204507583 | U | 7/2015 |

(56) References Cited

FOREIGN PATENT DOCUMENTS

| | | | | | |
|---|---|---|---|---|---|
| CN | 305674976 | | | 4/2020 | |
| DE | 522496 | | * | 4/1931 | ..... A45D 40/30 |
| DE | 2322360 | A1 | | 11/1973 | |
| FR | 1060527 | | * | 11/1953 | ..... A45D 40/30 |
| FR | 1596401 | A | | 6/1970 | |
| FR | 2231216 | | | 12/1974 | |
| FR | 2833531 | A1 | | 6/2003 | |
| FR | 2833531 | B1 | | 6/2004 | |
| GB | 191304814 | A | | 4/1913 | |
| JP | H09341 | U | | 6/1997 | |
| JP | 2005143736 | A | | 6/2005 | |
| JP | 2012035257 | A | | 2/2012 | |
| JP | 2016527972 | A | | 9/2016 | |
| KR | 20130095531 | A | | 8/2013 | |
| KR | 20160025871 | A | | 3/2016 | |
| KR | 20160059377 | A | | 5/2016 | |
| KR | 20160002585 | U | | 7/2016 | |
| TW | M493302 | U | | 1/2015 | |
| WO | 2003008000 | A1 | | 1/2003 | |
| WO | 2003070287 | A1 | | 8/2003 | |
| WO | 2003101499 | A1 | | 12/2003 | |
| WO | 2007048178 | A1 | | 5/2007 | |

OTHER PUBLICATIONS

Jacques, Renee Beautyblender's Newest Product Will Help You Get Instagram-Worthy Cat Eyes, Jan. 11, 2016. Retrieved from the Internet on Mar. 4, 2017.

International Search Report and Written Opinion for Serial No. PCT/US17/12851 dated Mar. 31, 2017.

Examination Report for Australia Design No. 201613951 dated Jun. 9, 2017.

Liner Designer By Beautyblender which was published on the website http://www.cosmopolitan.com.au/beauty/beauty-blender-eye-liner-designer-9940 on Jan. 15, 2016.

Liner Designer by Beautyblender which was published on the website https://twitter.com/BeautybloggerL/status/690227143603683328/photo/1?utm source-fb&utm_medium-fb &utm_campaign-BeautybloggerL&utm_content-690227143603683328 on Jan. 21, 2016.

How to use the beautyblender liner designer makeup tool, xoVain youtube.com, published on Feb. 25, 2016, retrieved on Aug. 3, 2018, retrieved from the Internet URL: https://www.youtube.corn/watch?v=aArDb5x0y1Y.

Beautylish, How should I store my beautyblender?, Sep. 8, 2014, https://www.beautylish.com/t/yuamrw/how-should-i-store-my-beautyblender.

* cited by examiner

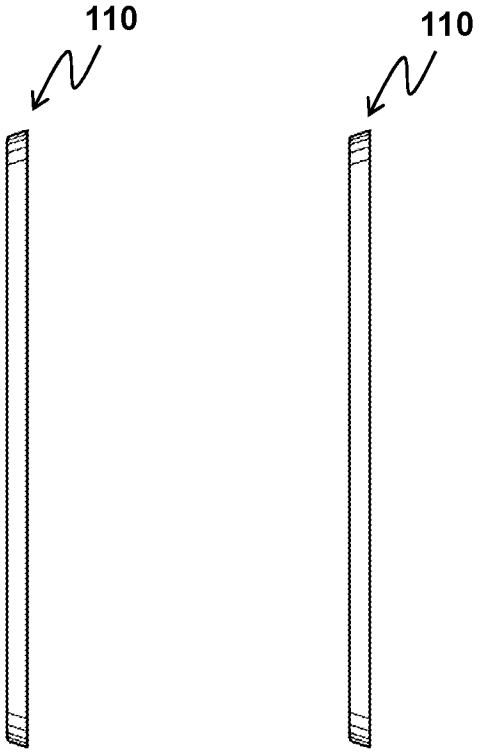
FIG. 8A
FIG. 8B
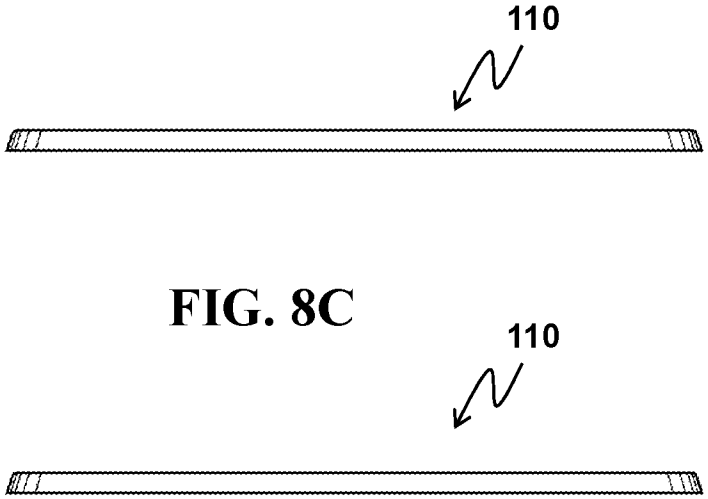
FIG. 8C
FIG. 8D

COSMETIC APPLICATOR TOOL AND CONTAINER SYSTEM

CROSS-REFERENCE TO RELATED APPLICATIONS

This application claims priority to and benefit of Design Patent application Ser. No. 29/552,719 filed Jan. 25, 2016 and Design patent application Ser. No. 29/556,321 filed Feb. 29, 2016, both of which are hereby incorporated by reference for all purposes.

TECHNICAL FIELD

The invention in its several embodiments relates to the field of cosmetic applicators and more particularly, to systems and methods for a device providing the ability and guidance to apply cosmetics to the skin.

SUMMARY

An exemplary system embodiment of the cosmetic applicator tool system may comprise: a cosmetic applicator tool made of flexible material with an outer surface, where the cosmetic applicator tool may comprise a tacky coating on the outer surface thereby providing an adhesive characteristic to adhere to a skin surface, and where the cosmetic applicator tool may be in a triangular shape, the triangular shape comprising three side edges and a set of three vertices, where the three side edges may be a combination of a rectilinear side, a first curvilinear side, and a second curvilinear side. In one embodiment, the first curvilinear side may comprise a different curvature angle than the second curvilinear side, where each vertex of the set of three vertices may be curved differently than a remaining set of vertices; and where the cosmetic applicator tool may be configured to: provide a guided mechanism for applying cosmetics to the skin. Optionally, in one embodiment, the cosmetic applicator tool may be made of flexible silicon material.

The exemplary system may further comprise: a storage housing comprising a removable lid member and a base member, where the base member may facilitate affixing to a solid flat surface, and where the storage housing may be configured to receive and store the cosmetic applicator tool. Additionally, the removable lid member may be detachably attached to the base member, where the removable lid member may be detachably attached to the base member via one or more hinges; and where the removable lid member may comprise a reflective surface for reflecting a clear image.

Additionally, the cosmetic applicator tool may be further configured to: adhere to the skin based on the cosmetic applicator tool being comprised of the tacky coating on the outer surface and through the cosmetic applicator tool undergoing an increase in temperature, where the increase in temperature may be through exposure to warmth of the skin surface. The exemplary cosmetic applicator tool may comprise a tacky coating on the outer surface that provides an adhesive characteristic to adhere to a skin surface without disrupting previously applied cosmetics.

In other embodiments, the cosmetic applicator tool may be further configured to provide a guide to help steady movement of an applicator on the skin by the cosmetic applicator tool, where the differently shaped side edges and differently shaped vertices may provide a number of different shapes to use as guidance. In addition, the rectilinear side may provide for drawing straight lines and the first curvilinear side and the second curvilinear side may provide for drawing curved lines, when used as guides. In one embodiment, the curvature angle of the first curvilinear side may be a higher degree than the curvature angle of the second curvilinear side. Accordingly, the triangular shape may comprise a range of angles for application of the cosmetic applicator tool based on a contact angle between the cosmetic applicator tool and the skin surface.

Method embodiments of the cosmetic applicator tool system may comprise the steps of: providing a cosmetic applicator tool made of flexible material with an outer surface, where the cosmetic applicator tool may be in a triangular shape, the triangular shape comprising three side edges and a set of three vertices, where the three side edges may be a combination of a rectilinear side, a first curvilinear side, and a second curvilinear side; where the first curvilinear side may comprise a different curvature angle than the second curvilinear side, and where each vertex of the set of three vertices may be curved differently than a remaining set of vertices; adhering to a skin surface by the cosmetic applicator tool, where the adhering may be based on the cosmetic applicator tool being comprised of a tacky coating on the outer surface; guiding, by the cosmetic applicator tool, application of cosmetics on the skin surface via providing a steady surface upon which to apply cosmetics; and improving, by the cosmetic applicator tool, creation of symmetry in appearance of cosmetics on the skin surface based on the guiding application of cosmetics and the adhering to the skin surface.

In one embodiment, the method may further comprise: storing the cosmetic applicator tool in a storage housing, the storage housing comprising a removable lid member and a base member. In another embodiment, the method may further comprise: guiding, by the cosmetic applicator tool, the application of cosmetics on the skin surface by drawing lines along at least one of: the three side edges and a set of three vertices. Yet in another embodiment, the method may further comprise: adhering to the skin surface by the cosmetic applicator tool, where the adhering may be based on the cosmetic applicator tool undergoing an increase in temperature. Optionally, the increase in temperature may be via exposure to warmth of the skin surface. The method may further comprise the step of: determining a set range of angles for applying the cosmetic applicator tool based on a contact angle between the cosmetic applicator tool and the skin surface; and adjusting placement of different corners of the cosmetic applicator tool against the skin surface via rotating the cosmetic applicator tool.

BRIEF DESCRIPTION OF THE DRAWINGS

Embodiments are illustrated by way of example and not limitation in the figures of the accompanying drawings, and in which:

FIG. 8A depicts a top plan view of the exemplary cosmetic applicator tool;

FIG. 8B depicts a bottom plan view of the exemplary cosmetic applicator tool;

FIG. 8C depicts a right side elevational view of the exemplary cosmetic applicator tool; and FIG. 8D depicts a left side elevational view of the exemplary cosmetic applicator tool.

BACKGROUND

Figure 1:
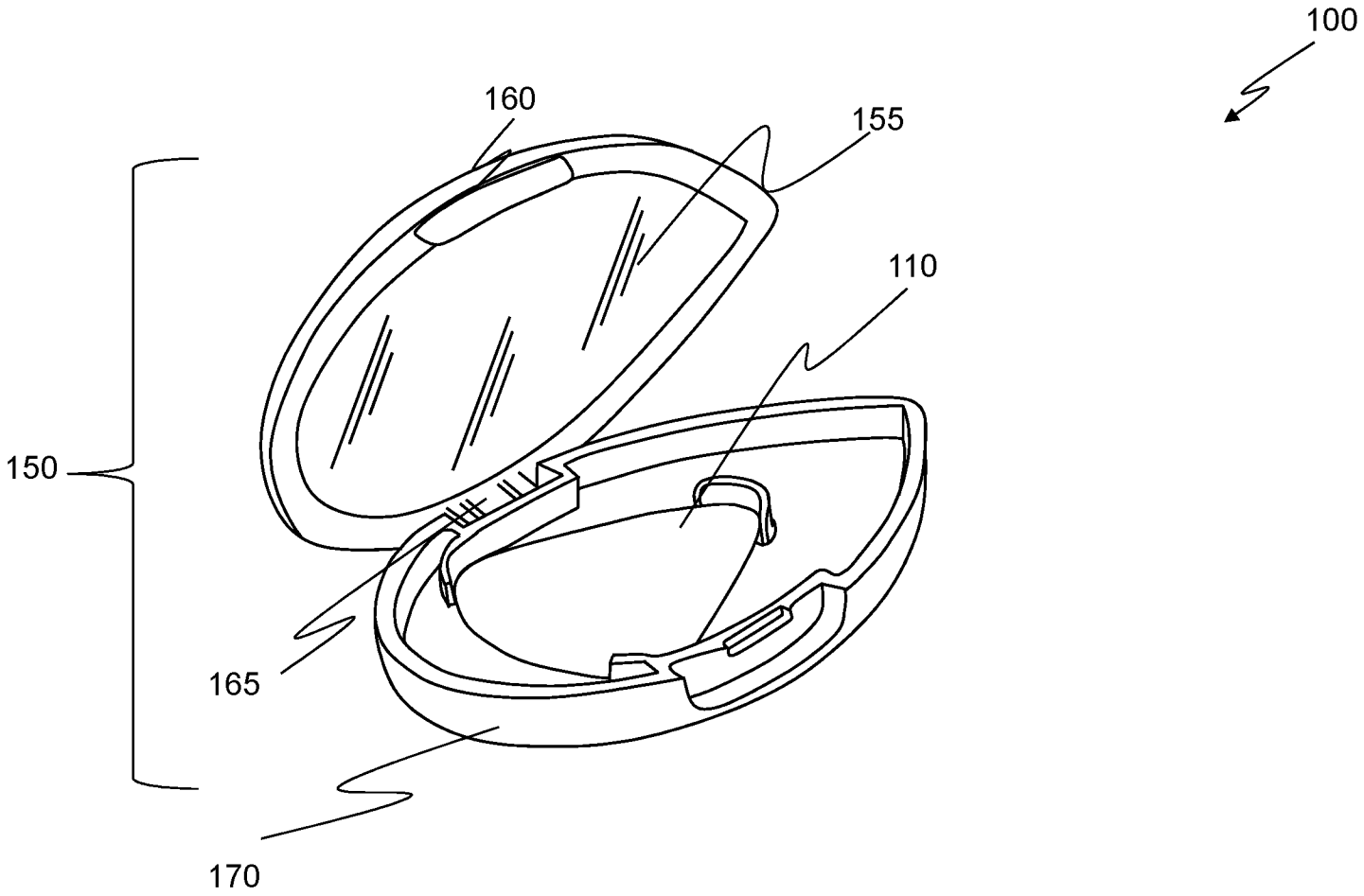
FIG. 1 depicts an exemplary embodiment of the cosmetic applicator tool system which may comprise a flexible cosmetic applicator tool.

For a person to apply cosmetics, for example, makeup, eyeliner, mascara, lipstick, and/or eye shadow, it is desirous that the cosmetics look consistent as applied on the skin. However, many users of cosmetics have to manually use their hands to neatly apply the cosmetics and face challenges in doing so. Naturally, a person's skin is not amenable to providing a steady or smooth surface and accordingly, the person would have to take great care and suffer much anguish in applying cosmetics.

One solution has been that individuals typically use thin, disposable tape or pieces of paper to aid in applying their cosmetics to their skin on a daily basis. Typically, the thin disposable tape or paper does not provide proper support and placing adhesive tape on the skin is often irritating to the skin. Additionally, such thin disposable tape or paper does not conform to the curvature of a human face and make it extremely difficult to apply cosmetics in an effective way.

DETAILED DESCRIPTION

A cosmetic applicator tool system may comprise a cosmetic applicator tool and a storage housing for storing the cosmetic applicator tool. The cosmetic applicator tool may be in a triangular shape combination of rectilinear and curvilinear sides, made of flexible material for guiding the application of cosmetics. With three unique sides forming, for example, a scalene triangle, the cosmetic applicator tool may provide a variety of boundaries for using as guide posts while applying cosmetics. Additionally, by the cosmetic applicator tool forming a triangle with three edges and three vertices, where each vertex is curved differently from the other two vertices, the cosmetic applicator tool may facilitate a variety of angles and shapes being drawn.

One embodiment of the cosmetic applicator tool may provide three edges, where a first edge may be straight, a second edge may be curved at a first angle, a third edge that may be curved at a second angle, and where the first angle and the second angle are different from each other. In this embodiment, the first angle and the second angle are tangential angles of a curve in the Cartesian plane, at a specific point, where the angles are the angle between the tangent line to the curve at a given point and the x-axis. That is, the second edge comprises a degree of curvature that may be different than the degree of curvature of the third edge.

The cosmetic applicator tool may be comprised of flexible material, such as, rubber or silicone, and provide a tacky coating on the outer surface. In one embodiment, silicone rubber may be used as an elastomer, i.e., rubber-like material, composed of silicone—itself a polymer—comprising silicon together with carbon, hydrogen, and oxygen, and having hypoallergenic characteristics. The cosmetic applicator tool may comprise a slightly tacky coating, e.g., to a small degree, so that it is not considerably of glue, or other substances, but may have the ability to retain a slightly sticky feel. The slightly tacky coating allows for the tool to adhere to the skin to help keep it in place. In one embodiment, the silicone, along with the tacky coating, effect the adherence of the cosmetic applicator tool to the skin via warming up the silicone for approximately 10-15 seconds. Accordingly, the cosmetic applicator tool may gently adhere to the skin and provide a guided support for securing and positioning the cosmetic applicator tool in order to apply cosmetics. Upon a rise in the temperature, for example, by rubbing the cosmetic applicator tool between the fingers, the tacky coating is activated allowing for the cosmetic applicator tool to be gently fastened to the skin, thereby, freeing the hands for other uses.

In one embodiment of the cosmetic applicator tool system, the cosmetic applicator tool may be shaped in a way so as to provide ease of use and ability to hold and apply cosmetics simultaneously. Accordingly, the cosmetic applicator tool may be in the shape of a three-sided guide with three unique sides, offering a variety of angles and liner shapes, for every eye shape and liner style. The cosmetic applicator tool may be flexible, i.e., capable of bending easily without breaking, and shaped to fit all contours of the face. In one embodiment, by gently sticking to the skin, the cosmetic applicator tool, without disturbing makeup, may provide a holding position. Accordingly, using the flexible material and shape, the cosmetic applicator tool may be ideal for effortlessly reaching every nook and corner of the face while affording a guided mechanism for applying cosmetics to the skin.

Embodiments of the cosmetic applicator tool utilize material having washable qualities which may then be reused after washing it with liquid. The cosmetic applicator tool may then be allowed to dry fully to return to the original form. In one embodiment of the cosmetic applicator tool system, the cosmetic applicator tool may be cleaned with a special cleanser and dried in a well-ventilated area.

Embodiments of the cosmetic applicator tool system comprise a storage housing for storing the cosmetic applicator tool and may be a volume-enclosing container for storage. The storage housing may comprise a removable and/or adjustable lid member that may be detachably attached via one or more hinges to a base member. The system may also comprise a base member, where the base member may receive a suction cup on the outer surface. In one embodiment of the cosmetic applicator tool system, a cosmetic applicator tool may be placed inside the storage housing via a set of arm brackets, while allowing the cosmetic applicator tool system to be detachably attached to a solid surface—affording the user the ability to use the mirror inside the lid member. The suction cup assembly may use the negative air pressure to adhere to nonporous surfaces, creating a partial vacuum.

FIG. 1 depicts an exemplary embodiment of the cosmetic applicator tool system 100 which may comprise a flexible cosmetic applicator tool 110, having characteristic abilities to stick to the skin to provide positioning guidance in applying cosmetics to the skin and a containing member, i.e., storage housing 150. This embodiment may also comprise a reflective surface, e.g., a mirror 155, placed on the inside of a removable and/or adjustable lid member 160 that may be detachably attached via one or more hinges 165 to a base member 170, thereby making it a mirrored compact. The mirror 155 may, in some embodiments, be one with a magnifying capability, for example, magnify by five times. The figure shows flexible cosmetic applicator tool 110 inside the storage housing 150. As described herein, the flexible cosmetic applicator tool 110 may be reusable and have the ability to temporarily stick to the skin via a tacky coating on the outer surface. Additionally, the storage housing 150 may comprise a base member 170 having three arm brackets (see FIG. 4) for holding the cosmetic applicator tool 110 in place.

Figure 2A:
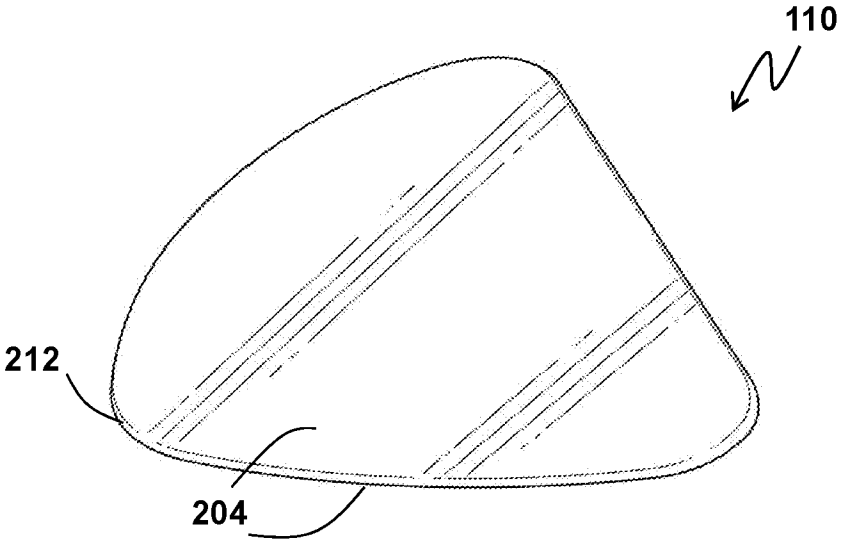
FIG. 2A depicts, in a perspective view, an exemplary cosmetic applicator tool of the cosmetic applicator tool system.

FIG. 2A depicts, in a perspective view, an exemplary cosmetic applicator tool 110 of the cosmetic applicator tool system 100. The cosmetic applicator tool 110 is shown as having a thickness 212—creating a volume between two surfaces 204—comprising silicon material, with optional anti-microbial agents. In one exemplary embodiment, the thickness 212 may be approximately 1 mm to 2 mm. In one embodiment, the anti-microbial agents may in effect inhibit the growth of bacteria. The cosmetic applicator tool 110 where the tool may comprise a tacky coating, the tool may be comprised of a silicone rubber having a layer of slightly tacky coating having the ability to retain a slightly sticky quality.

Figure 2B:
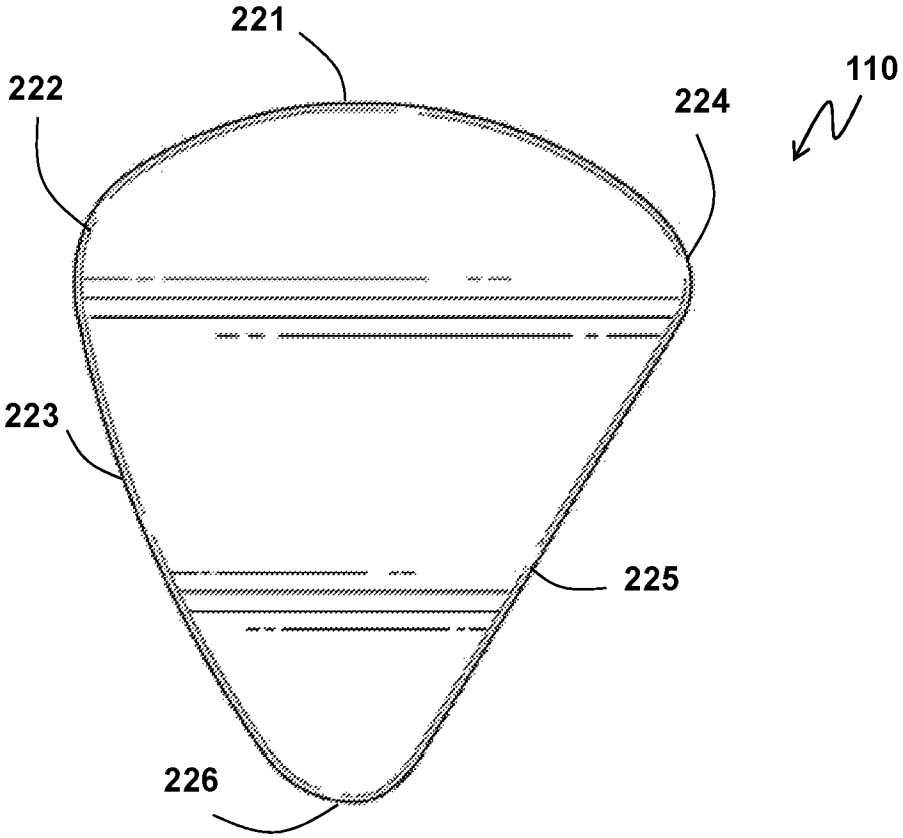
FIG. 2B depicts, in a top view, an exemplary cosmetic applicator tool of the cosmetic applicator tool system.

FIG. 2B depicts, in a top view, an exemplary cosmetic applicator tool 110 of the cosmetic applicator tool system 100. The cosmetic applicator tool 110 may be a triangular shaped combination of rectilinear 225 and curvilinear sides 221,223. In one exemplary embodiment, the rectilinear side may measure approximately 31 mm to 32 mm, where the one curvilinear side may also measure approximately 31 mm to 32 mm, and the other curvilinear side may measure approximately 28 mm to 29 mm. With three unique sides 221,223,225 forming, for example, a scalene triangle, the cosmetic applicator tool may provide a variety of boundaries for using as guide posts while applying cosmetics so as to offer different surface areas for usage on the skin. Additionally, by the cosmetic applicator tool forming a triangle with three side edges 221,223,225 and three vertices 222,224, 226, where each vertex is curved differently from the other two vertices, the cosmetic applicator tool 110 may facilitate a variety of angles and shapes being drawn. The cosmetic applicator tool 110 may provide different angles, curvatures, and lengths to be used on different target areas on the skin, with precision and ease. The cosmetic applicator tool 110 is therefore shaped and adapted to adjust to the curvatures of each human face based on how the user holds the cosmetic applicator tool 110 and which side of the cosmetic applicator tool 110 is applied against the skin.

In one embodiment of the exemplary cosmetic applicator tool 110, on one end, a more pointed vertex/corner 226 may allow for application to narrower and tapered areas, for example, near the eyes, without over reaching and without covering unwanted areas. The pointed vertex/corner 226 may, for example, be used to draw smaller and more succinct lines. On another end, a more rounded corner 224 may provide for even more precise positioning, whereas on the opposite end, a less rounded corner 222, i.e., more oval shaped curve, may be used for covering larger surface areas. Accordingly, the shape of the cosmetic applicator tool 110 enables control of the placement in different areas where via each corner, different shapes may be guided to be drawn. Additionally, the cosmetic applicator tool 110, having differently shaped side edges 221,223,225, allows for lines having different shapes and characteristic to be drawn while using the cosmetic applicator tool 110 as a guide. For example, the rectilinear 225 side may be used for drawing straight lines where the curvilinear sides 221,223 may be used as guides for drawing curved lines. In one embodiment, the cosmetic applicator tool 110 comprises curvilinear sides 221,223 that have different curvature angles. That is, a first curvilinear side 221 may provide a higher curvature angel than a second curvilinear side 223, while both provide guides for tracing or drawings curved lines, one provides a more angular curve effectively allowing a user to select from the different options which fit the variety of facial contours.

Figure 3:
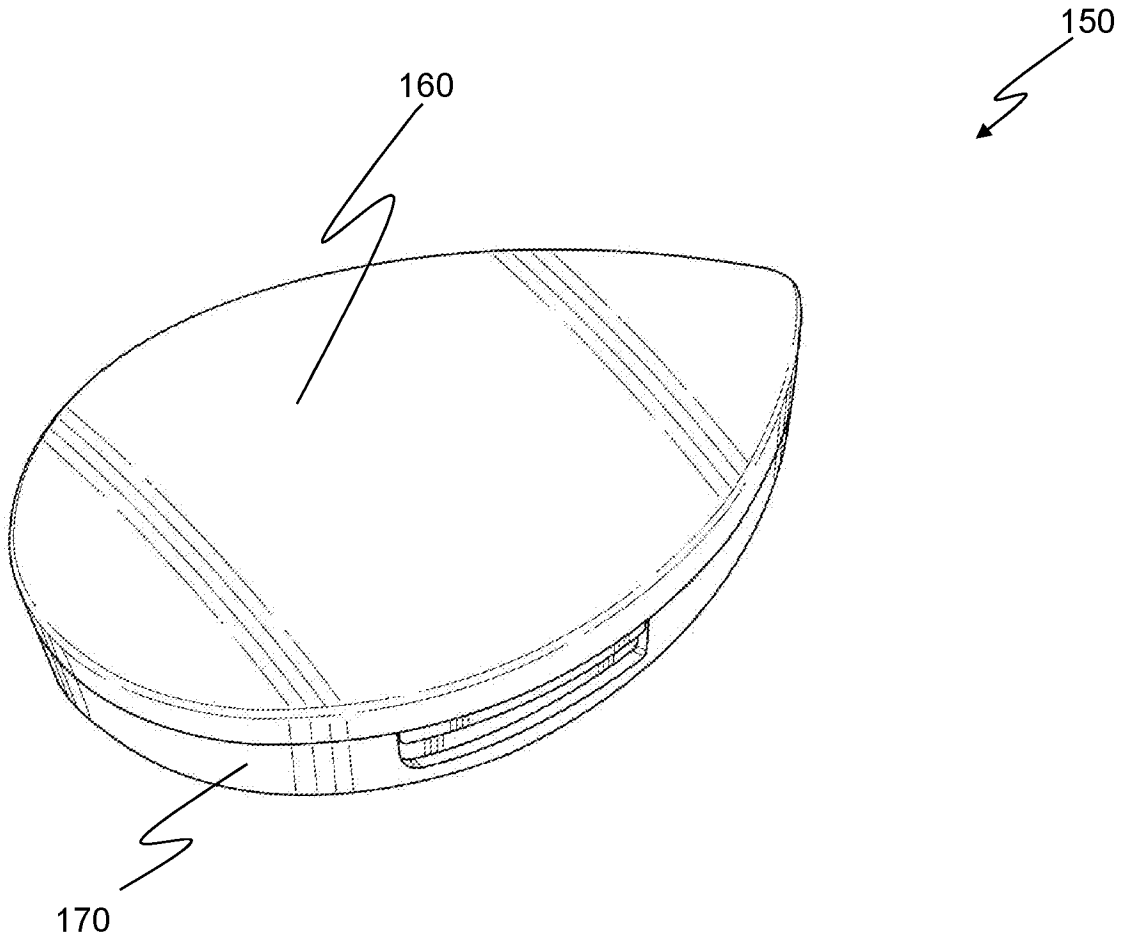
FIG. 3 depicts an exemplary embodiment of the storage housing of the cosmetic applicator tool system in a closed position.

FIG. 3 depicts an exemplary embodiment of the storage housing 150 of the cosmetic applicator tool system in a closed position. The storage housing 150 may comprise a removable and/or adjustable lid member 160 that may be detachably attached via one or more hinges (see 165 in FIG. 1) to a base member 170. The storage housing 150 may also have a mechanism for positioning and holding the removable and/or adjustable lid member 160 in relation to the base member 170 in a manner such that the removable and/or adjustable lid member 160 may be released by force applied to one of the parts, i.e., causing the removable and/or adjustable lid member 160 to pop open. The storage housing 150 may employ a clamping mechanism, a latching mechanism, or other mechanisms for coupling together the removable and/or adjustable lid member 160 to the base member 170.

Figure 4:
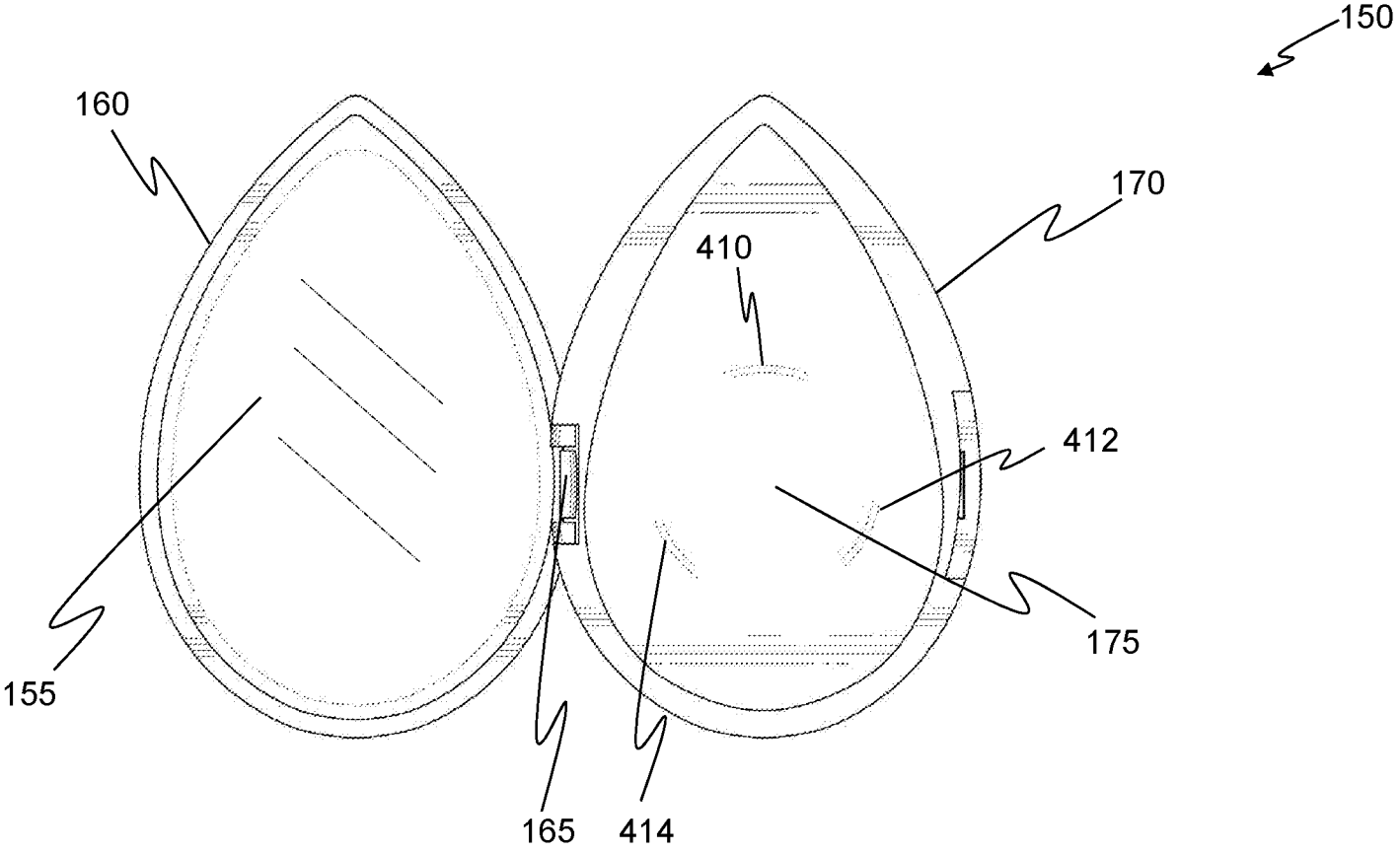
FIG. 4 depicts an exemplary embodiment of the storage housing of the cosmetic applicator tool system in an open position.

FIG. 4 depicts an exemplary embodiment of the storage housing 150 of the cosmetic applicator tool system in an open position. The storage housing 150 may comprise a removable and/or adjustable lid member 160 that may be detachably attached via one or more hinges 165 to the base member 170. The storage housing 150 may also have a mechanism for positioning and holding the removable and/or adjustable lid member 160 in relation to base member 170 in a manner such that the removable and/or adjustable lid member 160 may be released by force applied to one of the parts, i.e., causing the removable and/or adjustable lid member 160 to pop open. The storage housing 150 may have the base member 170 be detachably attached to the removable and/or adjustable lid member 160. When in the open position the removable and/or adjustable lid member 160 may house a mirror 155 to allow a user to observe themselves while applying cosmetics using the cosmetic applicator tool as a guide. The base member 170 is depicted as having an interior storage area 175, for example, enclosed within three curved or rounded shaped arm brackets 410, 412,414, where they may optionally be portions of concentric circles. In some embodiments, the interior storage area 175 may house a suction cup below the cosmetic applicator tool. The interior storage area 175 may allow for the suction cup to be removed easily and placed on the back of the base member 170, where it may be detachably attached to a solid flat surface for ease of use.

Figure 5:
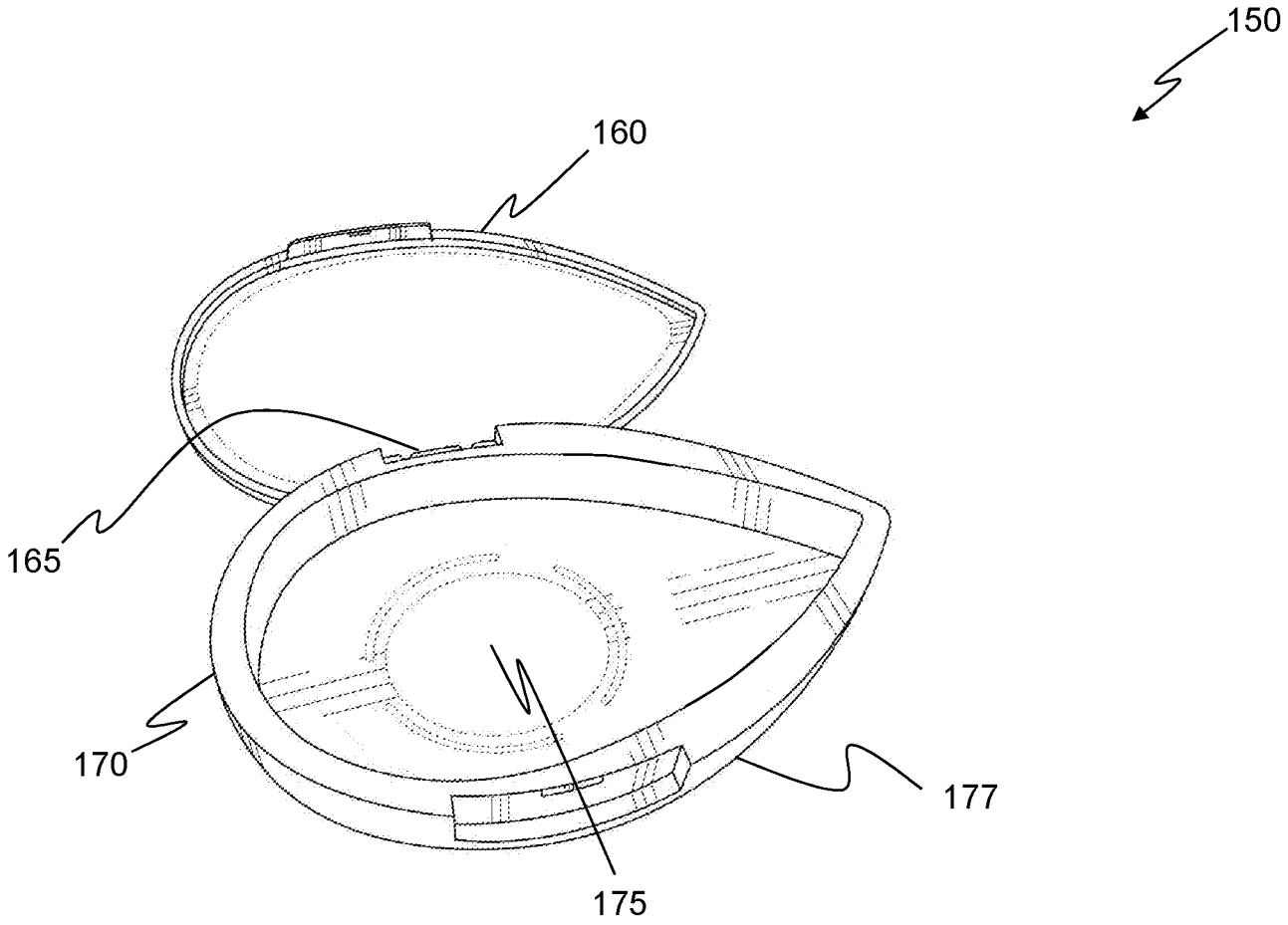
FIG. 5 depicts in a perspective view, an exemplary embodiment of the storage housing of the cosmetic applicator tool system in an open position.

FIG. 5 depicts in a perspective view, an exemplary embodiment of the storage housing 150 of the cosmetic applicator tool system in an open position. The storage housing 150 may comprise a removable and/or adjustable lid member 160 that may be detachably attached via one or more hinges 165 to the base member 170. The base member 170 is depicted as having an interior storage area 175, for example, in three curved or rounded shaped arm brackets. The interior storage area 175 allows for secure storage of the cosmetic applicator tool and an optional suction cup. Additionally, the base member 170 may comprise on the back portion 177, one or more concavities or cutout portions (not shown), which may allow securing of the suction cup while affixing the base member 170 on a solid flat surface. The concavity or cutout portion on the back of the base member 170, may be embodied as a dimple on the outer surface of the base member 170 and be arcuate shaped in a way so as to fit the suction cup.

Figure 6B:
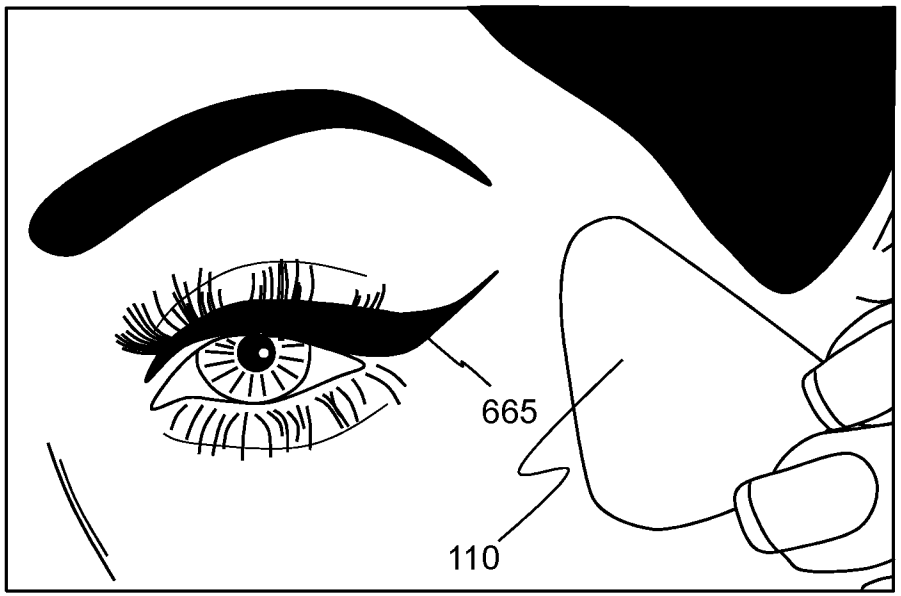
FIG. 6B depicts the cosmetic applicator tool as used in an exemplary application thereof.
Figure 6A:
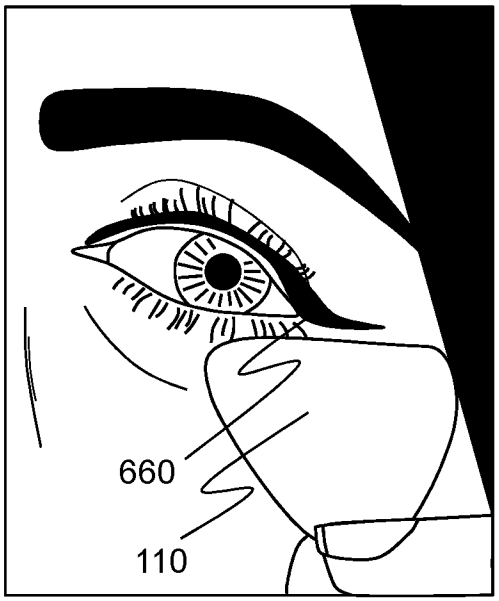
FIG. 6A depicts the cosmetic applicator tool as used in an exemplary application thereof.

FIGS. 6A and 6B depict the cosmetic applicator tool 110 as used in application thereof. As depicted in FIG. 6A, the cosmetic applicator tool 110 is placed in an area 660 identified by the user as being desirous to apply cosmetics and accordingly, provide guided support for accurately applying such cosmetics. In this example, the cosmetic applicator tool 110 is shown being placed below the lower eyelashes and around the eye contour, i.e., underneath the lower eyelashes, as shown. The cosmetic applicator tool 110 may then guard any cosmetic being applied and keep any cosmetics from being applied except to the desirous areas. In addition, since the corner edges of the cosmetic applicator tool 110 are rounded or curved, any discomfort or danger of injury may be eliminated. FIG. 6B depicts the cosmetic applicator tool 110 as being placed in an area adjacent to the eyebrows and eye where the cosmetic applicator tool 110 may facilitate application of cosmetics without the cosmetics being applied to the skin beneath. The cosmetic applicator tool 110 may be used on areas 665 where a guard helps provides support for drawing or applying cosmetics and simultaneously prevents the cosmetics from being applied to the skin where it is not intended to be.

Figure 7:
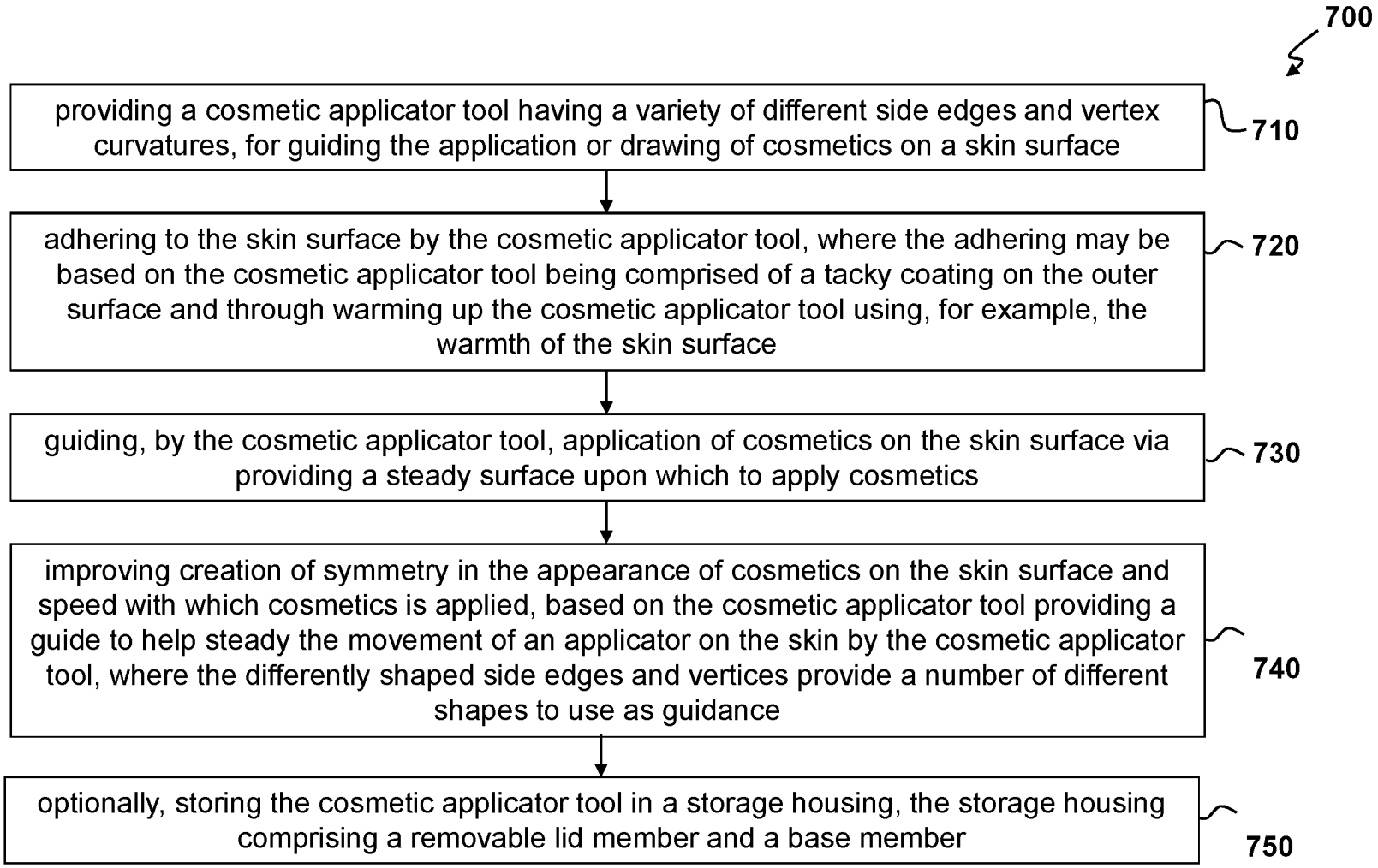
FIG. 7 depicts an exemplary flowchart for using the cosmetic applicator tool system.

FIG. 7 depicts an exemplary flowchart 700 for using the cosmetic applicator tool system, and more specifically, for applying cosmetics to the skin surface using the cosmetic applicator tool as a guiding tool, where the cosmetic applicator tool may be made of flexible silicone material. According to this exemplary method embodiment, the cosmetic applicator tool may be used by way of the following steps (not necessarily in this order): providing a cosmetic applicator tool having a variety of different side edges and vertex curvatures, for guiding the application or drawing of cosmetics on a skin surface (step 710); adhering to the skin surface by the cosmetic applicator tool, where the adhering may be based on the cosmetic applicator tool being comprised of a tacky coating on the outer surface and through undergoing an increase in temperature of the cosmetic applicator tool using, for example, the warmth of the skin surface (step 720); guiding, by the cosmetic applicator tool, application of cosmetics on the skin surface via providing a steady surface upon which to apply cosmetics, for example, mascara and/or eye shadow (step 730); and improving creation of symmetry in the appearance of cosmetics on the skin surface and speed with which cosmetics is applied, based on the cosmetic applicator tool providing a guide to help steady the movement of an applicator on the skin by the cosmetic applicator tool, where the differently shaped side edges and vertices provide a number of different shapes to use as guidance (step 740). Optionally, storing the cosmetic applicator tool in a storage housing, the storage housing comprising a removable lid member and a base member (step 750).

FIGS. 8A-8D depict a top plan view, a bottom plan view, a right side elevational view, and a left side elevational view of the exemplary cosmetic applicator tool 110, respectively. The elevational views depict the cosmetic applicator tool 110 as having a volume based on the surfaces enclosing an area, that may be made of material which may comprise tacky coating with adhesive characteristic to temporarily stick to the skin without disrupting previously applied cosmetics. The volume created may facilitate the guiding tool being comprised of flexible silicon material with optional anti-microbial agents dispersed within. In one embodiment, the tacky coating material on the outer surface of the cosmetic applicator tool may effect the steady affixing to the skin surface through application of a small amount of heat. That is, as the cosmetic applicator tool warms up, for example, via rubbing it in between the fingers, the adhesive characteristics of the cosmetic applicator tool help to gently and temporarily attach to the skin surface, leaving the cosmetic applicator tool having been placed in a desirable location or position substantially intact.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention is herein disclosed by way of examples and should not be limited by the particular disclosed embodiments described above.

What is claimed is:

1. A system comprising:

a cosmetic applicator tool made of flexible material with an outer surface, wherein the cosmetic applicator tool comprises a tacky coating on the outer surface thereby providing an adhesive characteristic configured to adhere to a skin surface;

wherein the cosmetic applicator tool is in a triangular shape, the triangular shape comprising three side edges and a set of three vertices, wherein the three side edges extend to connect the set of three vertices, wherein the three side edges are a combination of a rectilinear side edge, a first curvilinear side edge, and a second curvilinear side edge; wherein the first curvilinear side edge comprises a different curvature angle than the second curvilinear side edge; and wherein each vertex of the set of three vertices is curved differently than a remaining set of vertices;

wherein one vertex of the set of three vertices having a narrower curve angle than the other two vertices is formed between the rectilinear side edge and the first curvilinear side edge; and wherein each of the side edges of the cosmetic applicator tool are configured to guide in application of cosmetics to the skin.

2. The system of claim 1 further comprising:

a storage housing comprising a removable lid member and a base member, wherein the base member facilitates affixing to a solid flat surface, and wherein the storage housing is configured to receive and store the cosmetic applicator tool.

3. The system of claim 2 wherein the removable lid member is detachably attached to the base member.

4. The system of claim 3 wherein the removable lid member is detachably attached to the base member via one or more hinges.

5. The system of claim 3 wherein the removable lid member comprises a reflective surface for reflecting a clear image.

6. The system of claim 1 wherein the cosmetic applicator tool is made of flexible silicon material.

7. The system of claim 1 wherein the cosmetic applicator tool is further configured to:

adhere to the skin based on the cosmetic applicator tool being comprised of the tacky coating on the outer surface and through the cosmetic applicator tool undergoing an increase in temperature.

8. The system of claim 7 wherein the increase in temperature is through exposure to warmth of the skin surface.

9. The system of claim 1 wherein the cosmetic applicator tool comprising a tacky coating on the outer surface provides an adhesive characteristic to adhere to a skin surface without disrupting previously applied cosmetics.

10. The system of claim 1 wherein the cosmetic applicator tool is further configured to:

provide a guide to help steady movement of an applicator on the skin.

11. The system of claim 10 wherein the differently shaped side edges and differently shaped vertices provide a number of different shapes to use as guidance.

12. The system of claim 11 wherein the rectilinear side edge provides for drawing straight lines and wherein the first curvilinear side edge and the second curvilinear side edge provide for drawing curved lines, when used as guides.

13. The system of claim 12 wherein the curvature angle of the first curvilinear side edge is a higher degree than the curvature angle of the second curvilinear side edge.

14. The system of claim 13 wherein the triangular shape comprises a range of angles for application of the cosmetic applicator tool based on a contact angle between the cosmetic applicator tool and the skin surface.

15. A method comprising:

providing a cosmetic applicator tool made of flexible material with an outer surface, wherein the cosmetic applicator tool is in a triangular shape, the triangular shape comprising three side edges and a set of three vertices, wherein the three side edges extend to connect the set of three vertices, wherein the three side edges are a combination of a rectilinear side edge, a first curvilinear side edge, and a second curvilinear side edge; wherein the first curvilinear side edge comprises a different curvature angle than the second curvilinear side edge; wherein each vertex of the set of three vertices is curved differently than a remaining set of vertices; and wherein one vertex of the set of three vertices having a narrower curve angle than the other two vertices is formed between the rectilinear side edge and the first curvilinear side edge;

adhering to a skin surface by the cosmetic applicator tool, wherein the adhering is based on the cosmetic applicator tool being comprised of a tacky coating on the outer surface;

guiding, by the cosmetic applicator tool, application of cosmetics on the skin surface via providing a steady surface upon which to apply cosmetics, wherein the rectilinear side edge guides application of cosmetics on the skin surface in a straight line, and wherein the first curvilinear side edge and the second curvilinear side edge guide application of cosmetics on the skin surface in a curved line; and improving, by the cosmetic applicator tool, creation of symmetry in appearance of cosmetics on the skin surface based on the guiding application of cosmetics and the adhering to the skin surface.

16. The method of claim 15 further comprising:

storing the cosmetic applicator tool in a storage housing, the storage housing comprising a removable lid member and a base member.

17. The method of claim 15 further comprising:

guiding, by the cosmetic applicator tool, the application of cosmetics on the skin surface by drawing lines along at least one of: the three side edges and a set of three vertices.

18. The method of claim 17 further comprising:

adhering to the skin surface by the cosmetic applicator tool, wherein the adhering is based on the cosmetic applicator tool undergoing an increase in temperature.

19. The method of claim 18 wherein the increase in temperature is via exposure to warmth of the skin surface.

20. The method of claim 15 further comprising:

determining a set range of angles for applying the cosmetic applicator tool based on a contact angle between the cosmetic applicator tool and the skin surface; and adjusting placement of different corners of the cosmetic applicator tool against the skin surface via rotating the cosmetic applicator tool.

* * * * *